US009636281B2

(12) United States Patent
Makrinos et al.

(10) Patent No.: US 9,636,281 B2
(45) Date of Patent: May 2, 2017

(54) BOTTLE HOLDER

(71) Applicants: Stephen S. Makrinos, Garden City, NY (US); Angelica Makrinos, Garden City, NY (US)

(72) Inventors: Stephen S. Makrinos, Garden City, NY (US); Angelica Makrinos, Garden City, NY (US)

( * ) Notice: Subject to any disclaimer, the term of this patent is extended or adjusted under 35 U.S.C. 154(b) by 915 days.

(21) Appl. No.: 13/740,550

(22) Filed: Jan. 14, 2013

(65) Prior Publication Data

US 2014/0197125 A1 Jul. 17, 2014

(51) Int. Cl.
*A61J 9/08* (2006.01)
*A61J 9/06* (2006.01)

(52) U.S. Cl.
CPC ..... *A61J 9/0623* (2015.05); *A61J 9/0607* (2015.05)

(58) Field of Classification Search
CPC ..... A61J 9/00; A61J 9/06; A61J 9/0623
USPC ..... 215/11.6
See application file for complete search history.

(56) References Cited

U.S. PATENT DOCUMENTS 6,302,286 B1 * 10/2001 Witherspoon ..... A61J 11/008 215/11.1
8,152,012 B1 * 4/2012 Berglund ..... A45F 5/10 16/425
2005/0056609 A1 * 3/2005 Morano ..... A47G 19/2272 215/11.1
2005/0056611 A1 * 3/2005 Hakim ..... A61J 9/00 215/11.6
2005/0109725 A1 * 5/2005 Stewart ..... A61J 11/008 215/11.6
2009/0134112 A1 * 5/2009 Reeves ..... B65D 55/16 215/11.6
2009/0261054 A1 * 10/2009 Shelby ..... A61J 9/005 215/11.3
2014/0001142 A1 * 1/2014 Wu ..... A61J 9/02 215/11.2

* cited by examiner

*Primary Examiner* — Shawn M Braden
(74) *Attorney, Agent, or Firm* — Sorell, Lenna & Schmidt, LLP

(57) ABSTRACT

A bottle holder for attachment to a baby bottle including a frame having an opening for placement around the neck of the baby bottle and a cover configured to attach the frame to the bottle is provided. The frame has at least 2 handles positioned on opposite sides and extending outwardly away from the frame. The frame includes a flexible material and the opening of the frame widens when the first and second handles are squeezed inwardly towards one another in order to allow the neck of the baby bottle to be inserted into the opening of the frame.

19 Claims, 5 Drawing Sheets

BOTTLE HOLDER

BACKGROUND

The present disclosure relates to holders for bottles or cups, and more particularly to attachable holders for baby bottles that provide a pleasing and stimulating appearance to an infant or toddler.

There are several baby bottle holders available on the market. However, many of them are difficult for an infant or toddler to use or grasp, as they do not have flexible arms. An infant or toddler can easily drop bottles without flexible arms when they make a sudden movement. Some bottle holders available in the market do have flexible arms, however, the arms are often too rigid to allow a young baby to bend the arms by himself or herself.

Further, there are several available bottle holders that are over engineered and contain metal or fabric and thus pose hazards for their intended purpose. For example, metal holders are bad for growing teeth as babies love to bite anything within their reach. Metal holders also may rust over time and can not be warmed in a microwave. Moreover, fabric covered bottle holders present a cleaning problem and trap bacteria and mold.

In addition, most available baby bottle holders do not present any appearance much less a pleasing and stimulating appearance to an infant or toddler. Many baby bottle holders fit over the neck portion of a baby bottle and have two arms for a baby to hold. Such baby bottle holders typically do not catch the attention of an infant or baby.

Also, typically, the portion of a bottle holder that fits over the neck portion of a baby bottle is not adaptable to different neck sizes. Thus, consumers have to find a bottle holder that will fit the baby bottles they are using.

Accordingly, there is a need for a holder for baby bottles that has flexible arms which can be easily manipulated by an infant or toddler when the infant or toddler suddenly moves his or her body but not his or her head. Further, there is a need for a holder that is easily washable and includes a portion made of a material that is easily adaptable to different bottle neck sizes. Finally, a bottle holder should ideally present a pleasing and stimulating appearance to an infant or toddler, for example, through the use of bright colors and/or by designing the bottle holder itself in the form of an animal or other attractive and entertaining shape.

SUMMARY

New holders which are easily adaptable to various baby bottles and have flexible arms that can be easily manipulated by an infant or toddler when the infant or toddler makes a sudden movement are provided. The holders also provide a pleasing and stimulating appearance to an infant or toddler through the use of bright colors and/or designs on the holder itself—in the form of an animal or other attractive and entertaining shapes.

One embodiment of a bottle holder for attachment to a baby bottle provides for a bottle holder that includes: a frame having an opening for placement around the neck of the baby bottle, the frame having a first handle and a second handle positioned on opposite sides of the frame and extending outwardly away from the frame, and a cover configured to attach to the frame and enclose a portion of the baby bottle. The frame includes a flexible material. The opening of the frame widens when the first and second handles are squeezed inwardly towards one another in order to allow the neck of the baby bottle to be inserted into the opening of the frame and the opening of the frame surrounds and forms a press fit with the neck of the baby bottle when the first and second handles are released to move away from each other so as to removably attach the bottle holder to the baby bottle. The cover comprises means to lock the cover into a position so that a portion of the baby bottle is not exposed. The bottle holder can further include a third handle extending outwardly away from the frame such that the third handle is squeezed and released in the same manner as the first and second handles during attachment of the bottle holder to the baby bottle.

In another embodiment of a bottle holder for attachment to a baby bottle, the bottle holder includes a frame having an opening for placement around the neck of the baby bottle, a first handle attached to the frame by a first hinge and extending outwardly away from the frame, and a second handle attached to the frame by a second hinge and extending outwardly away from the frame. The first and second handles are positioned on opposite sides of the frame. The frame can include a flexible material. The bottle holder can be removably attached to the baby bottle by squeezing the first and second handles inwardly towards one another to widen the opening of the frame in order to allow the neck of the baby bottle to be inserted into the opening of the frame and then distracting the first and second handles away from each other so that the opening of the frame surrounds and forms a press fit with the neck of the baby bottle. The bottle holder can further include a cover for a portion of the baby bottle that can be attached to the frame by a third hinge. The third hinge can include a locking mechanism that allows the cover to lock into a position so that a portion of the baby bottle is not exposed. The bottle holder can further include a third handle attached to the frame by a fourth hinge and extending outwardly away from the frame. The third handle can be squeezed and released in the same manner as the first and second handles during attachment of the bottle holder to the baby bottle.

In yet another embodiment of a bottle holder for attachment to a baby bottle, the bottle holder includes: a frame having an opening for placement around the neck of the baby bottle, the frame having a first handle and a second handle positioned on opposite sides of the frame and extending outwardly away from the frame and the frame having a pair of tabs positioned along the opening, and a cover configured to attach to the frame and enclose a portion of the baby bottle. The frame includes a flexible material. The opening of the frame widens when the first and second handles are squeezed inwardly towards one another in order to allow the neck of the baby bottle to be inserted into the opening of the frame and the opening of the frame surrounds and forms a press fit with the neck of the baby bottle when the first and second handles are released to move away from each other so as to removably attach the bottle holder to the baby bottle.

In one embodiment of a bottle holder for attachment to a baby bottle, the bottle holder includes a housing comprising a flexible material and having first and second handles positioned on opposite sides of the housing and extending outwardly away from the housing. The housing includes an inner surface defining a passageway. The housing includes a first opening in communication with the passageway at an upper end of the housing configured for disposal of a portion of the baby bottle, such as, for example, a nipple, and a second opening in communication with the passageway at a lower end of the housing configured to receive the baby bottle. The passageway and/or the second opening widens when the first and second handles are squeezed inwardly towards one another in order to allow the baby bottle to be inserted through the second opening and into the passageway such that the nipple of the baby bottle extends through the first opening. The passageway and/or the second opening form a press fit with an outer surface of the baby bottle when the first and second handles are released to move away from each other so as to removably attach the bottle holder to the baby bottle. A cap is configured to engage the second opening and retain the baby bottle within the passageway.

In various embodiments, the flexible material of the frame can include a plastic. In some embodiments, the bottle holder and/or the frame can include a material that thermally insulates the contents of a baby bottle.

In various embodiments, the cover of the bottle holder can include the shape or design of the head of a cartoon character, an animal, an animal fictitious character, a fictitious character, a sports mascot or player, a person or any other entertaining character. Further, the first handle and the second handle can each have the shape of an arm of a cartoon character, an animal, an animal fictitious character, a fictitious character, a person, or any other entertaining character.

Additional features and advantages of various embodiments will be set forth in part in the description that follows, and in part will be apparent from the description, or may be learned by practice of various embodiments. The objectives and other advantages of various embodiments will be realized and attained by means of the elements and combinations particularly pointed out in the description and appended claims.

BRIEF DESCRIPTION OF THE DRAWINGS

In part, other aspects, features, benefits and advantages of the embodiments will be apparent with regard to the following description, appended claims and accompanying drawings where:

It is to be understood that the figures are not drawn to scale. Further, the relation between objects in a figure may not be to scale, and may in fact have a reverse relationship as to size. The figures are intended to bring understanding and clarity to the structure of each object shown, and thus, some features may be exaggerated in order to illustrate a specific feature of a structure.

DETAILED DESCRIPTION

For the purposes of this specification and appended claims, unless otherwise indicated, all numbers expressing quantities of ingredients, percentages or proportions of materials, reaction conditions, and other numerical values used in the specification and claims, are to be understood as being modified in all instances by the term "about." Accordingly, unless indicated to the contrary, the numerical parameters set forth in the following specification and attached claims are approximations that may vary depending upon the desired properties that are sought by the present disclosure. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value however, inherently contains certain errors necessarily resulting from the standard deviation found in their respective testing measurements. Moreover, all ranges disclosed herein are to be understood to encompass any and all subranges subsumed therein. For example, a range of "1 to 10" includes any and all subranges between (and including) the minimum value of 1 and the maximum value of 10, that is, any and all subranges having a minimum value of equal to or greater than 1 and a maximum value of equal to or less than 10, e.g., 5.5 to 10.

It is noted that, as used in this specification and the appended claims, the singular forms "a," "an," and "the," include plural referents unless expressly and unequivocally limited to one referent. Thus, for example, reference to "a handle" includes one, two, three or more handles.

Reference will now be made in detail to certain embodiments of the invention, examples of which are illustrated in the accompanying drawings. While the invention will be described in conjunction with the illustrated embodiments, it will be understood that they are not intended to limit the invention to those embodiments. On the contrary, the invention is intended to cover all alternatives, modifications, and equivalents, which may be included within the invention as defined by the appended claims.

Figure 1:
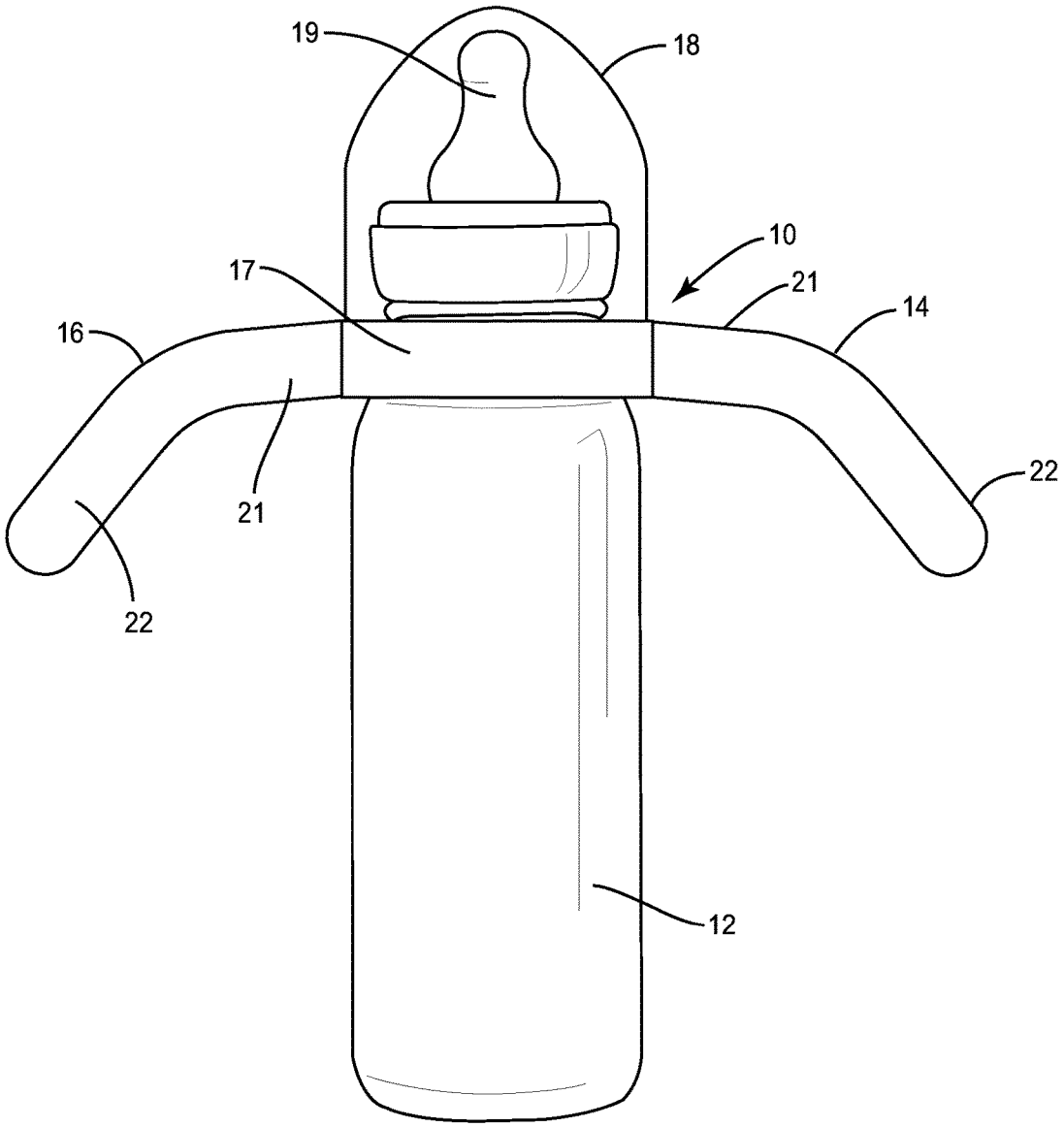
FIG. 1 is a front view of one embodiment of a bottle holder attached to a body bottle.

FIG. 1 is a front view of one embodiment of a bottle holder 10 as attached to a baby bottle 12. The bottle holder 10 has a frame 17 with a first handle 14 and a second handle 16 positioned on opposite sides of the frame 17. The frame 17 also has a cover 18 attached to it and the cover 18 encloses a portion, namely the nipple 19, of the baby bottle 12. Handles 14, 16 each include a first portion 21 extending transversely from frame 17 and a second portion 22 extending at an acute angle from portion 21. As shown in FIG. 1, portions 21 each extend from a bottom portion of frame 17 such that bottom surfaces of portions 21 are flush with a bottom portion of frame 17. It is envisioned that portions 21 may also extend from an upper portion of frame 17 such that upper surfaces of portions 21 are flush with an upper surface of frame 18. It is further envisioned that portions 21 may be positioned between the top and bottom surfaces of frame 17.

Figure 2:
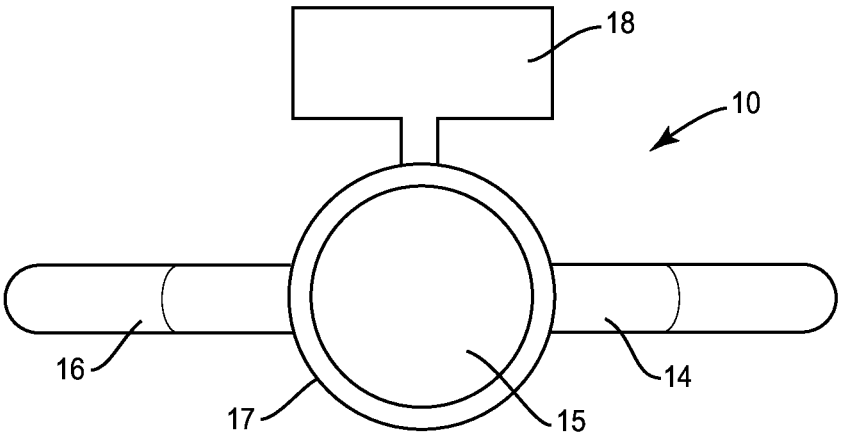
FIG. 2 is a top view of the bottle holder in FIG. 1 when it is not attached to a baby bottle.

The bottle holder 10 in FIG. 1 is further illustrated in FIG. 2. FIG. 2 shows a top view of the bottle holder 10 having a frame 17 with a first handle 14 and a second handle 16 positioned on opposite sides of the frame 17. The frame 17 has an opening 15 and comprises a flexible material such that the opening 15 widens to a stretched position when the first handle 14 and the second handle 16 are squeezed inwardly towards one another. The neck of a baby bottle can then be inserted into the opening 15. Then, when the first handle 14 and the second handle 16 are distracted to move away from each other, the opening 15 retracts toward its original position and as it does, the opening 15 surrounds and forms a press fit around the neck of the baby bottle. The bottle holder 10 is thereby secured to the baby bottle. The frame 17 in FIG. 2 also has a cover 18 attached to it and the cover 18 encloses a portion of the baby bottle. The press fit between the opening 15 and the neck of a baby bottle provides an added barrier to prevent leakage of the contents of the baby bottle. It is envisioned that the neck of the baby bottle can be inserted into opening 15 from either the bottom or the top of holder 10. As shown in FIG. 2, opening 15 has a circular cross section. It is contemplated that opening 15 may be variously configured and dimensioned, such as, for example, circular, oval, oblong, triangular, square, rectangular, polygonal, or irregular, depending on the requirements of a particular application.

Figure 3:
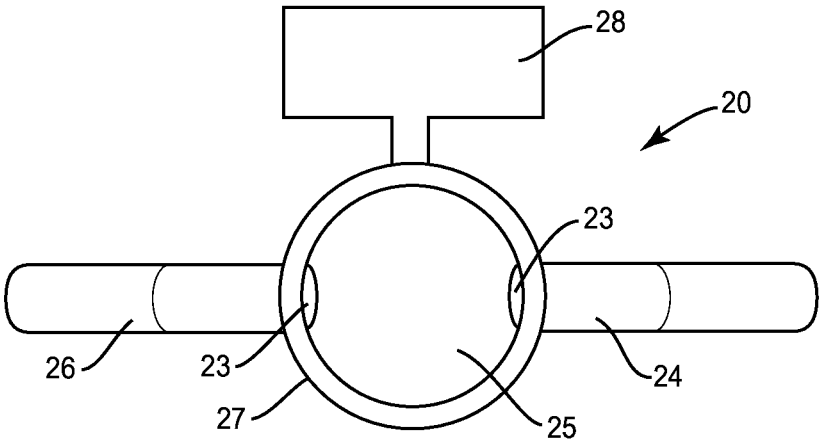
FIG. 3 is a top view of another embodiment of a bottle holder having a pair of tabs positioned in the opening of the frame.

FIG. 3 is a top view of another embodiment of a bottle holder 20. The bottle holder 20 has a frame 27 with a first handle 24 and a second handle 26 positioned on opposite sides of the frame 27. The frame 27 has an opening 25 and comprises a flexible material such that the opening 25 widens to a stretched position when the first and second handles, 24 and 26, are squeezed inwardly towards one another. The neck of a baby bottle can then be inserted into the opening 25. Then, when the first and second handles, 24 and 26, are distracted to move away from each other, the opening 25 retracts toward its original position and as it does, the opening 25 surrounds and forms a press fit with the neck of the baby bottle. The bottle holder 20 is thereby secured to the baby bottle. The frame 27 also has a pair of tabs 23, which further secure the neck of a baby bottle within the bottle holder 20 by the friction fit between the tabs 23, and the neck of a baby bottle. The frame 27 also has a cover 28 attached to it and the cover 28 encloses a portion of the baby bottle. In one embodiment, tabs 23 are made of a deformable material. As shown in FIG. 3, holder 20 includes a pair of tabs 23 positioned opposite one another. It is envisioned that holder 20 may include one or a plurality of tabs 23 circumferentially disposed about an inner surface of frame 27 that defines opening 25. It is further envisioned that tabs 23 may be uniformly spaced apart from one another, or randomly positioned about the inner surface of frame 27.

Figure 4:
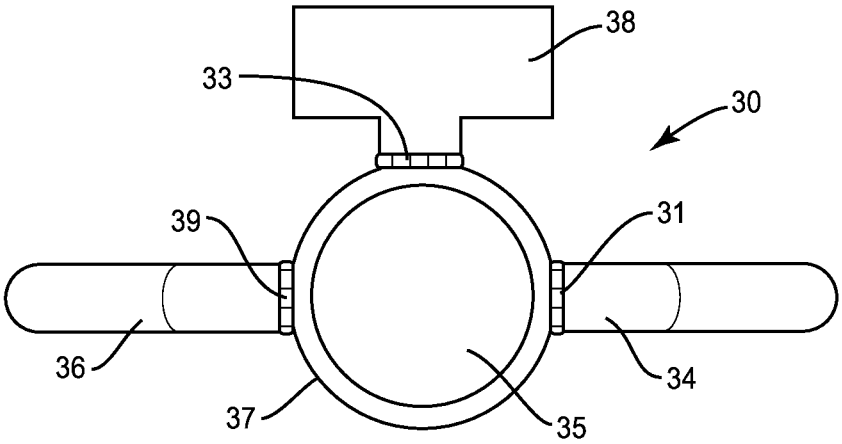
FIG. 4 is a top view of another embodiment of a bottle holder having a first handle, a second handle and a cover attached to the frame by hinges.

FIG. 4 illustrates another embodiment of a bottle holder 30 that functions in a similar manner to the bottle holders shown in FIGS. 2 and 3. The bottle holder 30 has a frame 37 having an opening 35 and comprising a flexible material. The frame 37 is attached to a first handle 34 by a first hinge 31, a second handle 36 by a second hinge 39, and a cover 38 by a third hinge 33. The cover 38 can enclose a portion of the baby bottle. Similar to the embodiments of bottle holders shown in FIGS. 2 and 3, the opening 35 widens to a stretched position when the first and second handles, 34 and 36, are distracted inwardly towards one another. The neck of a baby bottle can then be inserted into the opening 35. Then, when the first and second handles, 34 and 36, are released to move away from each other, the opening 35 retracts toward its original position and as it does, the opening 35 surrounds and forms a press fit with the neck of the baby bottle. The bottle holder 30 is thereby secured to the baby bottle. As shown in FIG. 4, handles 34, 36 are coaxial with one another. It is envisioned that handles 34, 36 may be disposed through angular ranges in various orientations relative to one another, such as, for example, transverse or perpendicular and/or other angular orientations such as acute or obtuse, and/or may be offset or staggered.

Figure 5:
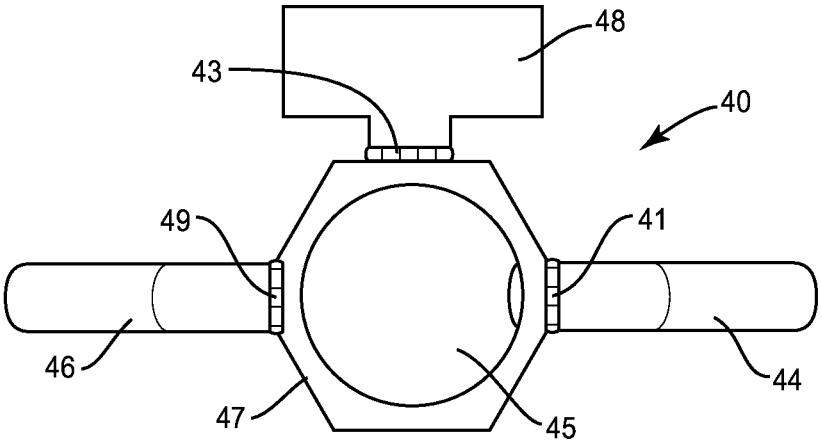
FIG. 5 is a top view of still another embodiment of a bottle holder having a hexagonal-shaped frame attached to a first handle, a second handle and a cover by hinges.

FIG. 5 shows a top view of still another embodiment of a bottle holder 40 having a hexagonal-shaped frame 47 attached to a first handle 44 by a first hinge 41, a second handle 46 by a second hinge 49, and a cover 48 by a third hinge 43. The frame 47 has an opening 45 and comprises a flexible material. Similar to the above embodiments of bottle holders shown in FIGS. 2-4, the neck of a baby bottle can be inserted into the opening 45 when it is widened to a stretched position by squeezing the first and second handles, 44 and 46, inwardly towards one another. Then, when the first and second handles, 44 and 46, are distracted and move away from each other, the opening 45 retracts toward its original position and as it does, the opening 45 surrounds and forms a press fit with the neck of the baby bottle. The bottle holder 40 is thereby secured to the baby bottle. In various embodiments, the frame 47 can alternatively have the shape of a square, octagon, triangle, trapezoid or other polygon. In some embodiments, the opening 45 can have the shape of a square, octagon, triangle, trapezoid or other polygon.

Figure 6:
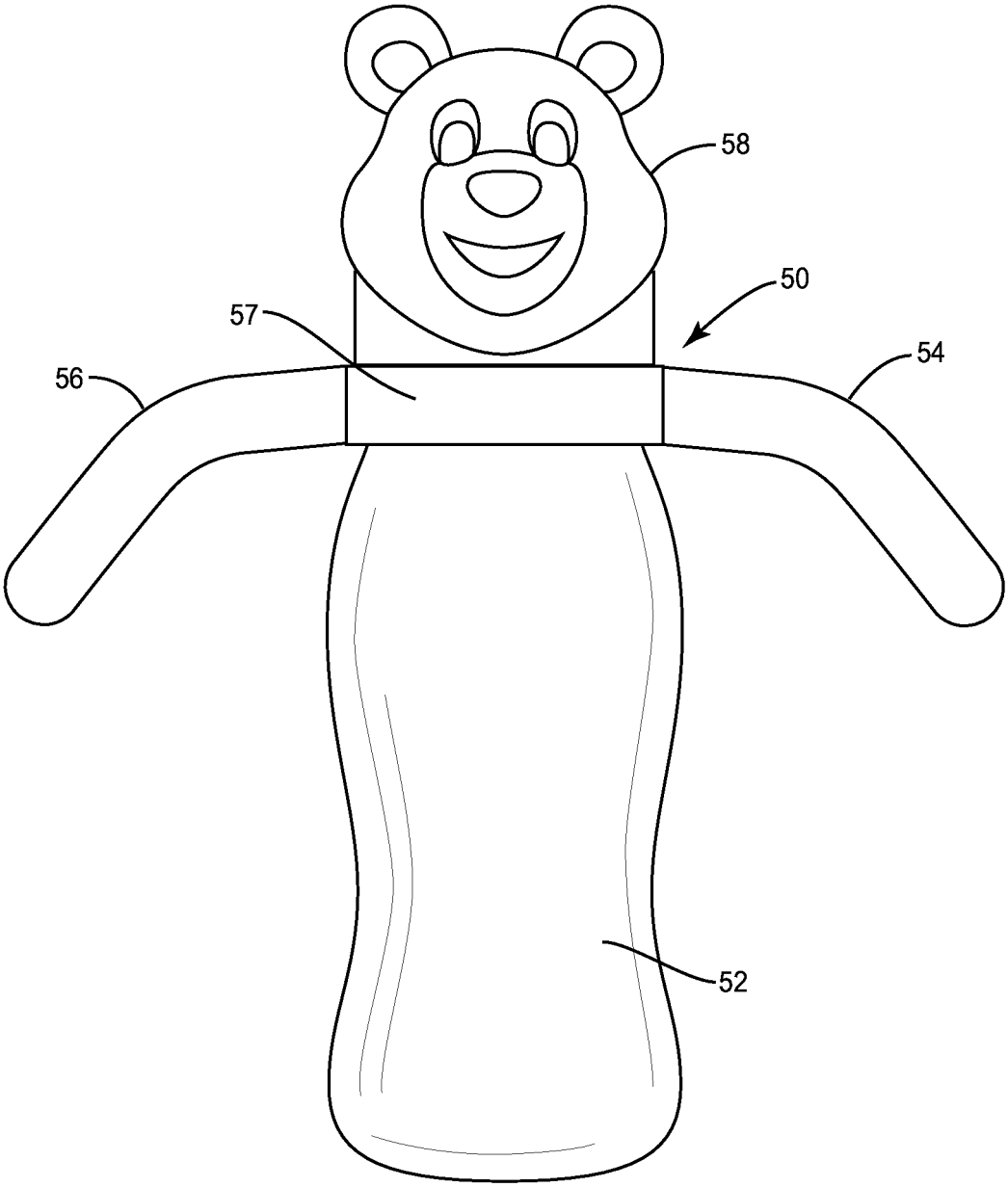
FIG. 6 is a front view of another embodiment of a bottle holder attached to a baby bottle, and having a cover in the shape of a bear's head.

FIG. 6 illustrates another embodiment of a bottle holder 50 as attached to a baby bottle 52. The bottle holder 50 has a frame 57 with a first handle 54 and a second handle 56 positioned on opposite sides of the frame 57. The frame 57 also has a cover 58 configured to enclose a portion, namely the nipple, of the baby bottle 52. The cover 58 has the shape of a bear's head. As shown in FIG. 6, handles 54, 56 each extend from frame 57 at an acute angle relative to frame 57. It is envisioned that handle 54 and/or handle 56 may be perpendicular to frame 57. It is further envisioned that handle 54 may extend from frame 57 at the same or a different angle than handle 56 extends from frame 57.

Figure 7:
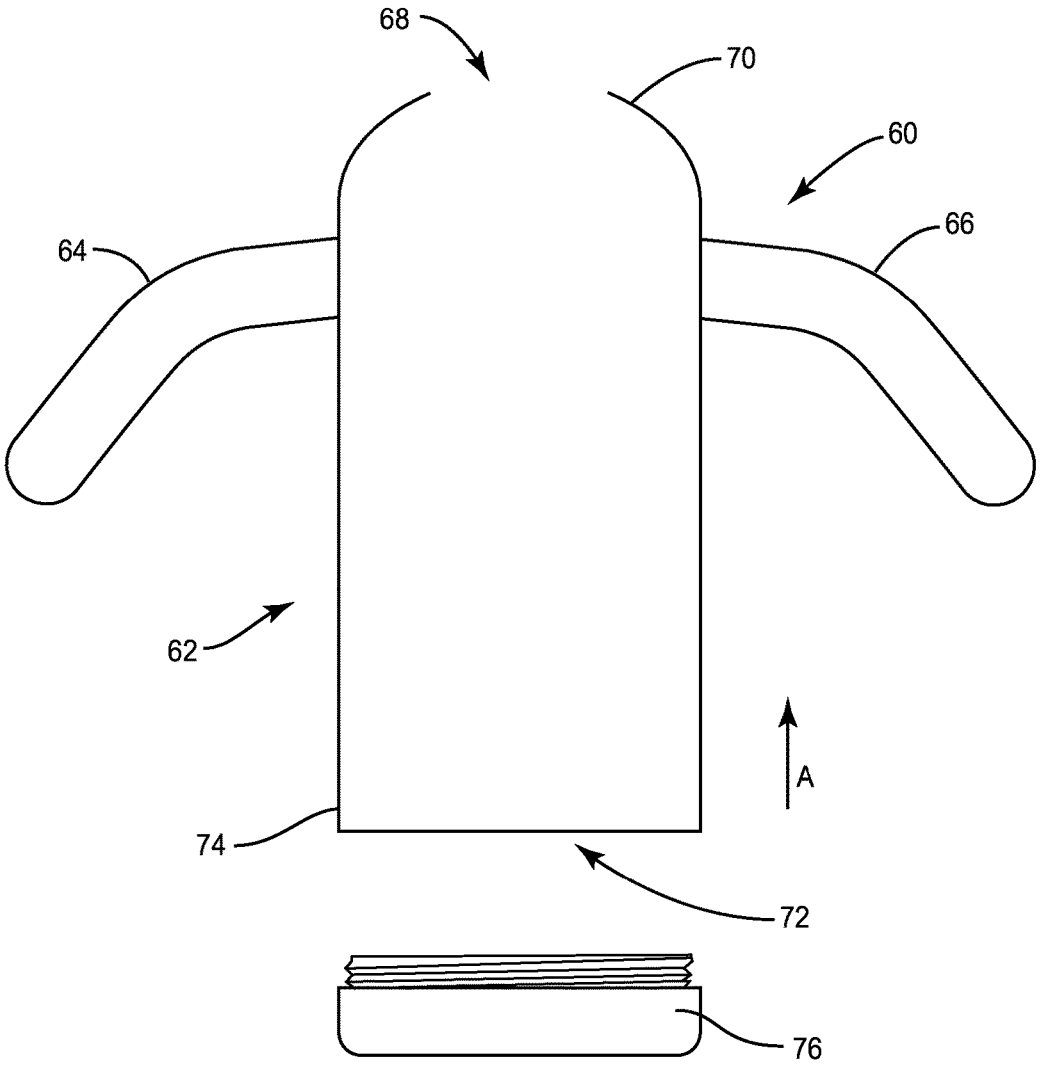
FIG. 7 is a side, cross-sectional view of one embodiment of a baby bottle holder in accordance with the principles of the present disclosure, with parts separated.

FIG. 7 illustrates a bottle holder 60 for attachment to a baby bottle. Holder 60 includes a housing 62 comprising a flexible material and having first and second handles 64, 66 positioned on opposite sides of housing 62 and extending outwardly away from housing 62. Housing 62 includes an inner surface defining a passageway. Housing 62 includes a first opening 68 in communication with the passageway at an upper end 70 of housing 62 configured for disposal of a portion of the baby bottle, such as, for example, a nipple. Housing 62 further includes a second opening 72 in communication with the passageway at a lower end 74 of housing 62 configured to receive the baby bottle. The passageway and/or second opening 72 widens when first and second handles 64, 66 are squeezed inwardly towards one another in order to allow the baby bottle to be inserted through second opening 72 and into the passageway such that the nipple of the baby bottle extends through first opening 68. The inner surface of housing 62 forms a press fit with an outer surface of the baby bottle when first and second handles 64, 66 are released to move away from each other so as to removably attach bottle holder 60 to the baby bottle. A cap 76 is configured to engage second opening 72 and retain the baby bottle within the passageway. In one embodiment, second opening 72 includes an internal or female thread form and an outer surface of cap 76 includes an external or male thread form configured to engage the thread form in second opening 72 to engage cap 76 with second opening 72. It is envisioned that cap 76 may be disposed with second opening 72 in alternate fixation configurations, such as, for example, friction fit, pressure fit, locking protrusion/recess, locking keyway and/or adhesive.

In various embodiments, the frame and handles are a one-piece construction fabricated from a resilient flexible material including open or closed foam, ethyl vinyl acetate (EVA), rubber such as sub-butadiene rubber (SBR), plastic or combinations thereof. EVA for example allows for good flexibility and firmness as well as the ability to retain the frame and handles in a position as the user manipulates them. Rubber is resilient and infants can teeth on it without damaging their teeth or gums. Plastic is another option that infants can teeth on without damaging their teeth or gums. Plastic is lightweight, inexpensive, durable, sufficiently strong to resist tearing, and can be easily produced in a variety of colors. Plastic is also easy to clean, is dishwasher-safe and can be safely heated in a microwave without effecting the contends of the bottle, such as, for example, milk or formula. Plastic can also be imprinted with a desired commercial message anywhere on its surface. Such materials allow for a one-piece construction that is lightweight and inexpensive and can be easily manufactured in large numbers. In some embodiments where the frame and handles are a one-piece construction and fabricated from the same resilient flexible material, the handles are fabricated to not have as much flexibility as the frame. This will allow for a user to apply sufficient force to push inward the handles while widening the opening of the frame to insert a baby bottle into the bottle holder. Where the frame and handles are a one-piece construction, a cover can be attached to the frame by various means including a hinge, glue and staples. The cover can be fabricated from a plastic, EVA, foam, SBR or combinations thereof.

In some embodiments, the frame, handles and cover are a one-piece construction fabricated from a resilient flexible material including open or closed foam, EVA, SBR, plastic or combinations thereof. The handles and cover are fabricated to not have as much flexibility as the frame.

In some embodiments, the frame, handles and cover are separate pieces that are attached by various means including hinges, staples and glue. The hinges can be made of metal, plastic, rubber and combinations thereof. Glues that can be used should have a sufficiently strong bonding strength to permanently attach the handles to the frame. The frame and handles can be fabricated from open or closed foam, EVA, SBR, plastic or combinations thereof. The handles are fabricated to not have as much flexibility as the frame. This will allow for a user to apply sufficient force to push inward the handles while widening the opening of the frame to insert a baby bottle into the bottle holder.

In some embodiments, the bottle holder and/or the frame include a material that thermally insulates the contents of a baby bottle. The material can be a plastic material such as polyethylene, polypropylene, PVC and/or polycarbonate. The material can include additives to improve resistance thereof to impacts and abrasions.

In various embodiments, the frame has a pair of tabs which help to secure the neck of a baby bottle within the bottle holder by the friction fit between the tabs and the neck of a baby bottle. The tabs can be fabricated from the same material as the frame including open or closed foam, EVA, SBR, plastic or combinations thereof. The tabs should have dimensions sufficient to allow for a friction fit with the neck of a baby bottle. The tabs in some embodiments are fabricated to not have as much flexibility as the frame so as to provide a strong friction fit with the neck of a baby bottle.

In various embodiments, the cover of the bottle holder can include the shape or design of the head of a cartoon character, an animal, an animal fictitious character, a fictitious character, a person, sports mascot or player, or any other entertaining character. In various embodiments, the cover encloses a portion of a baby bottle such as the neck of a baby bottle, the nipple of the baby bottle, or part of the body of a baby bottle.

The handles of the various embodiments of bottle holders can be in the shape of an arm of a cartoon character, animal, animal fictitious character, fictitious character, person, or other entertaining character. The dimensions of the handles should be sufficient to allow an infant or toddler to easily grasp a baby bottle. The handles in some embodiments have enough flexibility to allow for an infant or toddler to manipulate or bend the handles when the infant or toddler suddenly moves his or her body but not his or her head. Furthermore, in some embodiments, the ends of the handles have the hands of a cartoon character, an animal, an animal fictitious character, a fictitious character, a person, or any other entertaining character.

It will be apparent to those skilled in the art that various modifications and variations can be made to various embodiments described herein without departing from the spirit or scope of the teachings herein. Thus, it is intended that various embodiments cover other modifications and variations of various embodiments within the scope of the present teachings.

What is claimed is:

1. A bottle holder for attachment to a baby bottle having a neck, the bottle holder consisting of:

a frame having an opening for placement around the neck of the baby bottle, the frame having a first handle and a second handle positioned on opposite sides of the frame extending outwardly away from the frame, and a cover irremovably attached to the frame and configured enclose a portion of the baby bottle;

wherein the frame comprises a flexible material; and wherein the opening of the frame widens when the first and second handles are squeezed inwardly towards one another in order to allow the neck of the baby bottle to be inserted into the opening of the frame and the opening of the frame surrounds the neck of the baby bottle when the first and second handles are distracted to move away from each other so as to removably attach the bottle holder to the baby bottle.

2. The bottle holder of claim 1, wherein the flexible material comprises a plastic.

3. The bottle holder of claim 1, wherein the flexible material thermally insulates contents of the baby bottle.

4. The bottle holder of claim 1, wherein the cover comprises means to lock the cover into a position so that the portion of the baby bottle is not exposed.

5. The bottle holder of claim 1, wherein the frame comprises a pair of tabs disposed extending outwardly from an inner surface of the frame that defines the opening.

6. The bottle holder of claim 5, wherein the tabs are positioned opposite one another.

7. The bottle holder of claim 1, wherein the frame is monolithic.

8. The bottle holder of claim 1, wherein the frame comprises one or a plurality of tabs disposed about an inner surface of the frame that defines the opening.

9. The bottle holder of claim 8, wherein the tabs extend outwardly from the inner surface.

10. The bottle holder of claim 8, wherein the tabs are made of a deformable material.

11. The bottle holder of claim 8, wherein the tabs are circumferentially disposed about the inner surface.

12. The bottle holder of claim 8, wherein the tabs and the frame are each fabricated from a material.

13. The bottle holder of claim 12, wherein the material is closed foam.

14. The bottle holder of claim 12, wherein the material is ethylene-vinyl acetate.

15. The bottle holder of claim 12, wherein the material is styrene-butadiene.

16. The bottle holder of claim 8, wherein the tabs comprise a material having less flexibility than the flexible material of the frame so as to provide a strong friction fit with the neck of a baby bottle.

17. A bottle holder for attachment to a baby bottle having a neck, the bottle holder consisting of:

a frame having an opening for placement around the neck of the baby bottle, the frame having a first handle and a second handle positioned on opposite sides of the frame and extending outwardly away from the frame and the frame having a pair of tabs positioned along the opening; and a cover irremovably attached to the frame and configured to enclose a portion of the baby bottle;

wherein the frame comprises a flexible material; and wherein the opening of the frame widens when the first and second handles are squeezed inwardly towards one another in order to allow the neck of the baby bottle to be inserted into the opening of the frame and the opening of the frame surrounds the neck of the baby bottle when the first and second handles are distracted to move away from each other so as to removably attach the bottle holder to the baby bottle.

18. The bottle holder of claim 17, wherein the flexible material comprises a plastic.

19. The bottle holder of claim 17, wherein the flexible material thermally insulates contents of the baby bottle.

* * * * *